US007431420B2

(12) United States Patent
Inoue

(10) Patent No.: US 7,431,420 B2
(45) Date of Patent: Oct. 7, 2008

(54) PRINTING SYSTEM, CONTROLLER, PRINT JOB CREATION APPARATUS, METHOD OF EXECUTING PRINTING PROCESS, AND PROGRAM

(75) Inventor: Kazuhiro Inoue, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 286 days.

(21) Appl. No.: 11/277,247

(22) Filed: Mar. 23, 2006

(65) Prior Publication Data

US 2006/0214979 A1 Sep. 28, 2006

(30) Foreign Application Priority Data

Mar. 28, 2005 (JP) ..... 2005-090679

(51) Int. Cl.
*B41J 2/165* (2006.01)

(52) U.S. Cl. ..... 347/23; 347/29; 347/30; 347/32

(58) Field of Classification Search ..... 347/14, 347/22–24, 29, 30, 32, 33, 35, 42
See application file for complete search history.

(56) References Cited

U.S. PATENT DOCUMENTS 6,896,351 B1 * 5/2005 Satake ..... 347/23

FOREIGN PATENT DOCUMENTS

| | | |
|---|---|---|
| JP | 55-139269 | 10/1980 |
| JP | 9-216388 | 8/1997 |
| JP | 2002-225301 | 8/2002 |
| JP | 2003-39703 | 2/2003 |
| JP | 2003-127429 | 5/2003 |

* cited by examiner

*Primary Examiner*—Shih-Wen Hsieh
(74) *Attorney, Agent, or Firm*—McDermott Will & Emery LLP

(57) ABSTRACT

During the creation of print job data on a job creation terminal, a flushing pattern placement reservation region is previously arbitrary specified and described in placement condition data. Flushing pattern data is previously stored in a storage part. A flushing judgment part specifies frequency with which ink is ejected from each nozzle of a printing apparatus from rasterized data, to judge whether a flushing operation is needed or not. When the flushing operation is needed, a printing execution instruction part acquires the flushing pattern data for causing the ink ejected from a target nozzle to form a certain flushing pattern, to combine the flushing pattern data with the rasterized data, and the printing apparatus executes printing based on the resultant data obtained by the combination. This achieves the production of a printed material while ensuring the flushing operation.

18 Claims, 8 Drawing Sheets

FIG. 6

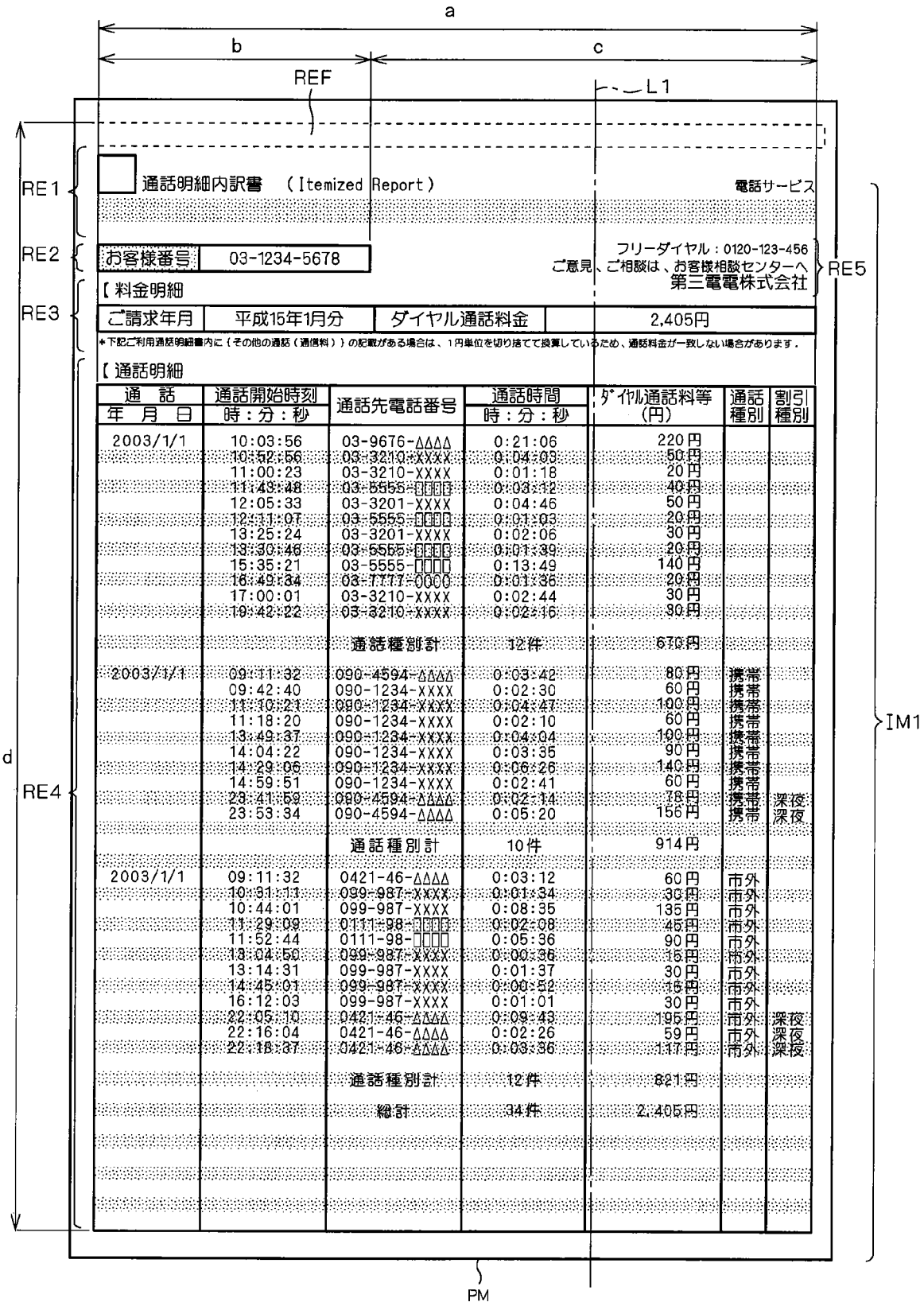

| 通話 年月日 | 通話開始時刻 時：分：秒 | 通話先電話番号 | 通話時間 時：分：秒 | ダイヤル通話料等（円） | 通話種別 | 割引種別 |
|---|---|---|---|---|---|---|
| 2003/1/1 | 10:03:56 | 03-9676-ΔΔΔΔ | 0:21:06 | 220円 | | |
| | 10:52:56 | 03-3210-XXXX | 0:04:03 | 50円 | | |
| | 11:00:23 | 03-3210-XXXX | 0:01:18 | 20円 | | |
| | 11:43:48 | 03-5555-□□□□ | 0:03:12 | 40円 | | |
| | 12:05:33 | 03-3201-XXXX | 0:04:46 | 50円 | | |
| | 12:11:07 | 03-5555-□□□□ | 0:01:03 | 20円 | | |
| | 13:25:24 | 03-3201-XXXX | 0:02:06 | 30円 | | |
| | 13:30:46 | 03-5555-□□□□ | 0:01:39 | 20円 | | |
| | 15:35:21 | 03-5555-□□□□ | 0:13:49 | 140円 | | |
| | 16:49:34 | 03-7777-0000 | 0:01:36 | 20円 | | |
| | 17:00:01 | 03-3210-XXXX | 0:02:44 | 30円 | | |
| | 19:42:22 | 03-3210-XXXX | 0:02:16 | 30円 | | |
| | | 通話種別計 | 12件 | 670円 | | |
| 2003/1/1 | 09:11:32 | 090-4594-ΔΔΔΔ | 0:03:42 | 80円 | 携帯 | |
| | 09:42:40 | 090-1234-XXXX | 0:02:30 | 60円 | 携帯 | |
| | 11:10:21 | 090-1234-XXXX | 0:04:47 | 100円 | 携帯 | |
| | 11:18:20 | 090-1234-XXXX | 0:02:10 | 60円 | 携帯 | |
| | 13:49:37 | 090-1234-XXXX | 0:04:04 | 100円 | 携帯 | |
| | 14:04:22 | 090-1234-XXXX | 0:03:35 | 90円 | 携帯 | |
| | 14:29:06 | 090-1234-XXXX | 0:06:26 | 140円 | 携帯 | |
| | 14:59:51 | 090-1234-XXXX | 0:02:41 | 60円 | 携帯 | |
| | 23:41:59 | 090-4594-ΔΔΔΔ | 0:02:14 | 78円 | 携帯 | 深夜 |
| | 23:53:34 | 090-4594-ΔΔΔΔ | 0:05:20 | 156円 | 携帯 | 深夜 |
| | | 通話種別計 | 10件 | 914円 | | |
| 2003/1/1 | 09:11:32 | 0421-46-ΔΔΔΔ | 0:03:12 | 60円 | 市外 | |
| | 10:31:11 | 099-987-XXXX | 0:01:34 | 30円 | 市外 | |
| | 10:44:01 | 099-987-XXXX | 0:08:35 | 135円 | 市外 | |
| | 11:29:09 | 0111-98-□□□□ | 0:02:08 | 45円 | 市外 | |
| | 11:52:44 | 0111-98-□□□□ | 0:05:36 | 90円 | 市外 | |
| | 13:04:50 | 099-987-XXXX | 0:00:36 | 15円 | 市外 | |
| | 13:14:31 | 099-987-XXXX | 0:01:37 | 30円 | 市外 | |
| | 14:45:01 | 099-987-XXXX | 0:00:52 | 15円 | 市外 | |
| | 16:12:03 | 099-987-XXXX | 0:01:01 | 30円 | 市外 | |
| | 22:05:10 | 0421-46-ΔΔΔΔ | 0:09:43 | 195円 | 市外 | 深夜 |
| | 22:16:04 | 0421-46-ΔΔΔΔ | 0:02:26 | 59円 | 市外 | 深夜 |
| | 22:18:37 | 0421-46-ΔΔΔΔ | 0:03:36 | 117円 | 市外 | 深夜 |
| | | 通話種別計 | 12件 | 821円 | | |
| | | 総計 | 34件 | 2,405円 | | |

FIG. 7

FP

☆☆☆

PRINTING SYSTEM, CONTROLLER, PRINT JOB CREATION APPARATUS, METHOD OF EXECUTING PRINTING PROCESS, AND PROGRAM

BACKGROUND OF THE INVENTION

1. Field of the Invention

The present invention relates to a flushing process in an inkjet printing apparatus having a fixed print head.

2. Description of the Background Art

There has been a widespread proliferation of inkjet printing apparatuses (or so-called inkjet printers) of the type in which printing is done on predetermined paper by the ejection or the like of fine (misty) ink particles (referred to also as ink droplets and the like) from a plurality of nozzle tips provided in a print head and having a very small diameter. In terms of print head configurations, the inkjet printing apparatuses are classified broadly into two types: a movable-head printing apparatus which performs printing by ejecting ink droplets in succession while moving a print head responsible for printing; and a fixed-head (line-head) printing apparatus which performs printing on a line-by-line basis while feeding a printing paper sheet immediately under a fixed print head having a size large enough to cover the width of the printing paper sheet.

The inkjet printing apparatuses of either type suffer from a print defect resulting from improper ejection and the like if the drying of ink due to the evaporation of a solvent near nozzles, the entry of bubbles into the nozzles or the deposition of dust onto the nozzles takes place during printing.

Some of the inkjet printers are intended to eliminate the ejection defect by executing a wipe process for wiping tip portions (nozzle portions) of the print head and a suction process for sucking up an unwanted substance from the tip portions. However, the execution of these processes requires the inkjet printers to have mechanisms therefor. Additionally, the need to execute a different operation than a printing process results in the decrease in throughput. In the use of a fixed line head of large size, a movement operation just for executing the process for such maintenance requires considerable time, which is not efficient in cost.

To avoid such problems, an inkjet printing apparatus configured to carry out flushing (also known as idle ejection, preliminary ejection and the like) during printing is known in the art, the flushing being the process of forcibly executing an ink ejection operation independent of what is to be printed under predetermined conditions. Such inkjet printing apparatuses are disclosed, for example, in Japanese Patent Application Laid-Open No. 2003-39703, Japanese Patent Application Laid-Open No. 2002-225301, Japanese Patent Application Laid-Open No. 2003-127429, Japanese Patent Application Laid-Open No. 55-139269 (1980), and Japanese Patent Application Laid-Open No. 9-216388 (1997).

The ink ejection operation executed by the printing apparatus during the flushing process is essentially identical with the ejection operation during the printing process. It is hence unnecessary to add a special mechanical component to the inkjet printing apparatus in order to execute the flushing process. A more important consideration is when to perform the flushing. Specifically, there arises a need to determine the position and pattern of ink ejection on a printing paper sheet so as not to interfere with what is to be originally printed. Additionally, more ink than necessary need not be ejected in ordinary cases because it is only necessary to prevent the drying of ink and the like.

Japanese Patent Application Laid-Open No. 2003-39703, Japanese Patent Application Laid-Open No. 2002-225301 and Japanese Patent Application Laid-Open No. 2003-127429 disclose the ejection of ink onto various regions (a perforated tear-off region, a binding margin region, a region between images, a region for bleeding and the like) of a printing paper sheet. Japanese Patent Application Laid-Open No. 2003-127429 also discloses a technique such that a pattern formed by the flushing is used as a mark for bleeding of a printed sheet. These disclosed techniques present a problem in that it is sometimes impossible to perform the flushing process because of the absence of the regions to be subjected to the ink ejection depending on what is to be printed. When such techniques are applied to the fixed-head inkjet printing apparatus, in particular, all of the nozzles arranged in line in the print head must stand ready to perform the flushing process at some point in time. This imposes a limit on when to eject the ink. As a result, there are cases where effective flushing is not carried out.

Japanese Patent Application Laid-Open No. 55-139269 (1980) discloses a technique in which the ink ejection by flushing is performed discretely on a printing sheet so that the ejected ink is inconspicuous on the printed sheet. This technique, however, may be undesirable in the case of low-resolution printing in which the dots are large in size because of conspicuity of the dots.

Japanese Patent Application Laid-Open No. 9-216388 (1997) discloses a technique employed for an inkjet printing apparatus capable of four-color printing using CMYK. In this inkjet printing apparatus, inks for CMY images are ejected for flushing from nozzles onto a position where ink for a K image is to be ejected and inks for CMY images are not in use, so as to be concealed under the ink for the K image, so that the flushing is performed in an inconspicuous manner. This technique, however, does not perform the idle ejection of the ink for the K image onto the printing sheet.

SUMMARY OF THE INVENTION

The present invention is intended for a flushing process in an inkjet printing apparatus having a fixed print head.

According to the present invention, a printing system comprises: a) a printing apparatus including a fixed print head having a plurality of nozzles arranged in an array, the printing apparatus ejecting ink from the plurality of nozzles based on predetermined printing data to perform printing on a printing sheet; and b) a controller for the printing apparatus, the controller including b-1) a storage element for storing predetermined information therein, b-2) a generation element for generating the printing data in accordance with descriptions of predetermined print job data stored in the storage element, b-3) a judgment element for acquiring information about whether the plurality of nozzles are open or closed during a printing process for the print job data in the printing apparatus to judge whether a flushing operation of the plurality of nozzles is needed or not based on the information, and b-4) a combination element for combining flushing data with the printing data in accordance with a predetermined condition, the flushing data being data for causing the flushing operation in a predetermined timed relationship during the printing process, the flushing data being previously stored in the storage element, the flushing data being combined with the printing data when the judgment element judges that the flushing operation is needed.

The printing system eliminates the presence of nozzles having no opportunity to eject ink for a long period of time during the printing for a printed sheet set composed of a multiplicity of printed sheets or for continuous roll of paper, thereby preventing the drying of the nozzles and the like. This achieves the improvement in print quality of the whole printed sheet set.

Preferably, the printing system further comprises c) a print job creation apparatus including c-1) a layout element for creating layout data, the layout data representing a layout for a printed material, and c-2) a reservation element for creating reservation data, the reservation data specifying a placement reservation position in which a flushing pattern represented by the flushing data is to be placed on the printed material, the print job data including the layout data and the reservation data, wherein, when it is judged that the flushing operation is needed, the combination element combines the flushing data with the printing data in accordance with descriptions of the reservation data, and the printing apparatus prints the flushing pattern in the placement reservation position.

Thus, the position in which the flushing operation, when needed, is executed on the printed material is previously determined as the placement reservation region in accordance with the descriptions of the layout data, whereby the flushing pattern is formed so as not to prevent the original visual effect of the printed material.

It is therefore an object of the present invention to provide an inkjet printing apparatus having a fixed print head and capable of performing a flushing process with greater flexibility during a printing process, and a method of executing the flushing process.

These and other objects, features, aspects and advantages of the present invention will become more apparent from the following detailed description of the present invention when taken in conjunction with the accompanying drawings.

BRIEF DESCRIPTION OF THE DRAWINGS

FIG. 6 illustrates a printed material subjected to no flushing operation;

FIG. 7 illustrates a printed material with a flushing pattern printed thereon based on flushing pattern data.

DESCRIPTION OF THE PREFERRED EMBODIMENTS

<System Configuration>

Figure 1:
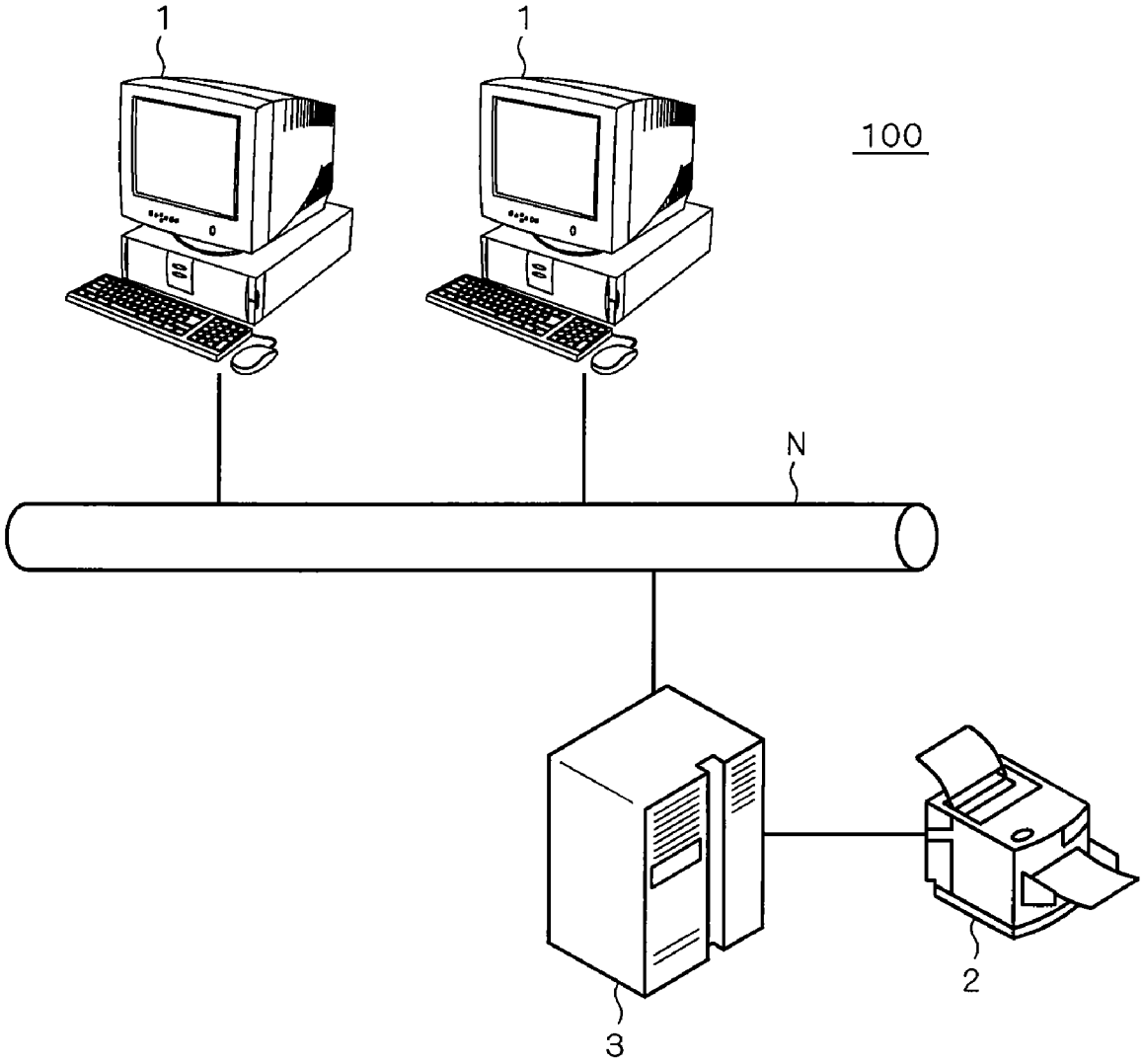
FIG. 1 schematically shows a construction of a printing system according to the present invention.
Figure 2:
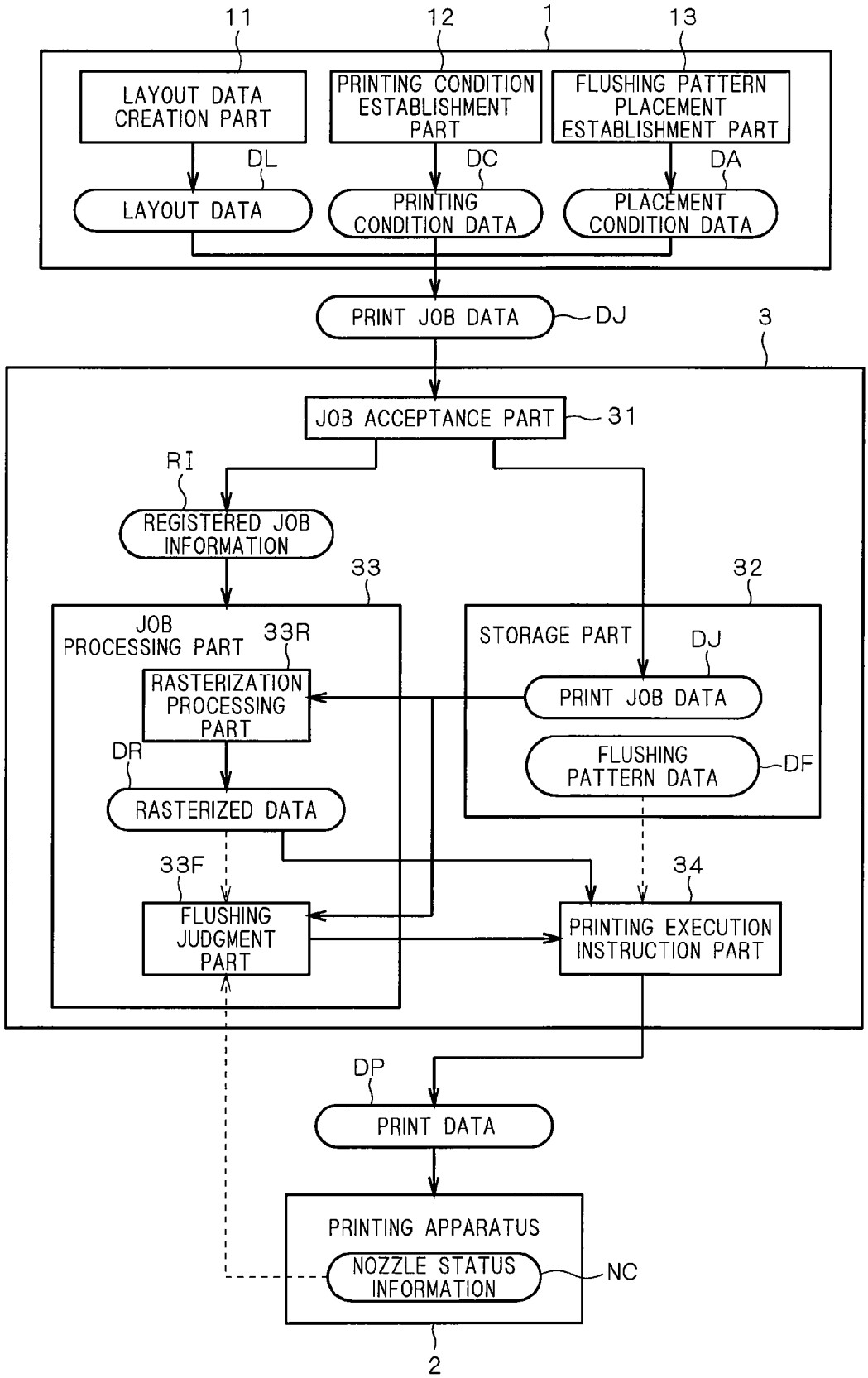
FIG. 2 is a functional block diagram of the printing system.

FIG. 1 schematically shows a construction of a printing system 100 according to a preferred embodiment of the present invention. FIG. 2 is a functional block diagram of the printing system 100. As shown in FIG. 1, the printing system 100 includes at least one job creation terminal 1 (although two job creation terminals 1 are shown in FIG. 1), a printing apparatus 2 for inkjet printing, and a controller 3 electrically connected to the printing apparatus 2 and for controlling the operation of the printing apparatus 2. The job creation terminal 1 and the controller 3 are connected to each other by way of a network N such as a (wired) LAN to constitute a so-called client server system. The job creation terminal 1 and the controller 3 may be connected to each other through a wireless communication element not shown or be capable of transferring and receiving data to and from each other through a predetermined recording medium. Although the two job creation terminals 1 are illustrated in FIG. 1 and the single job creation terminal 1 is illustrated in FIG. 2, the number of job creation terminals 1 provided in the printing system 100 is not limited to one and two. Three or more job creation terminals 1 may be connected to the controller 3.

The job creation terminal 1 is a client terminal implemented by a so-called personal computer. A predetermined job creation program is read by the (or each) job creation terminal 1 and executed by a CPU, a RAM and a ROM not shown, whereby a layout data creation part 11, a printing condition establishment part 12 and a flushing pattern placement establishment part 13 are principally implemented.

The layout data creation part 11 is provided to create data (layout data DL) representing the layout for a sheet to be printed. The printing condition establishment part 12 is provided to create data (printing condition data DC) representing various conditions (resolution, sheet size, the number of sheets, and the like) to be established by the printing apparatus 2 for printing. The flushing pattern placement establishment part 13 is provided to create data (placement condition data DA) which establishes placement conditions for printing a flushing pattern. Print job data DJ is created as data including these data DL, DC and DA. A layout process and a process for establishing the placement conditions in the job creation terminal 1 are performed by using a GUI (Graphical User Interface).

The created print job data DJ is passed through the network N to the controller 3. When the plurality of job creation terminals 1 are provided in the printing system 100 as shown in FIG. 1, the print job data DJ is created in each of the job creation terminals 1 and passed to the controller 3.

The controller 3 is provided to control a printing process in the printing apparatus 2. The controller 3 is implemented by a so-called server computer. A predetermined control program is read by the controller 3 and executed by a CPU, a RAM and a ROM not shown, whereby a job acceptance part 31, a storage part 32, a job processing part 33 and a printing execution instruction part 34 are principally implemented.

The job acceptance part 31 registers the print job data DJ sent from the (or each) job creation terminal 1 (or makes job registration) so that the print job data DJ is subjected to the printing process, and generates registered job information RI. The print job data DJ is temporarily stored in the storage part 32.

The storage part 32 is responsible for storing the print job data DJ to be subjected to the printing process, and for storing various data including, for example, flushing pattern data DF. The flushing pattern data DF is raster data for use in causing the printing apparatus 2 to perform a flushing operation as part of a flushing process. The details of the flushing process and the flushing operation will be described later. The storage part 32 includes recording media such as a RAM, a hard disc and the like (not shown).

The job processing part 33 specifies target print job data DJ which is to be processed by reference to the registered job information RI, obtains the target print job data DJ from the storage part 32, and performs a process required for the printing apparatus 2 to execute the printing process. To this end, the job processing part 33 includes a rasterization processing part 33R, and a flushing judgment part 33F.

The rasterization processing part 33R performs a rasterization process on the layout data DL included in the target print job data DJ to create rasterized data DR processable by the printing apparatus 2. Known techniques are applicable to the rasterization process.

The flushing judgment part 33F is responsible for the process of judging whether the flushing operation is needed during the printing process for the target print job data DJ or not in accordance with a predetermined criterion, as part of the flushing process. Such a process is referred to as a flushing judgment. The details of the flushing judgment will be described later.

The printing execution instruction part 34 is responsible for instructing the printing apparatus 2 to execute the printing. The printing execution instruction part 34 sends the rasterized data DR created based on the target print job data DJ and the printing condition data DC included in the target print job data DJ, as print data DP, to the printing apparatus 2 to cause the printing apparatus 2 to perform the printing process for the print data DP. For the printing process to obtain printed sheets of a plurality of pages or a printed sheet of continuous form paper, the data may be successively provided in certain processible units, e.g. on a page-by-page basis, to the printing apparatus 2.

When it is judged by the flushing judgment part 33F that the flushing operation is needed for certain print job data DJ, the printing execution instruction part 34 combines predetermined flushing pattern data DF previously stored in the storage part 32 with the rasterized data DR. The flushing operation is performed in the printing apparatus 2 by executing the printing process using the rasterized data DR with which the flushing pattern data DF is combined.

Figure 3:
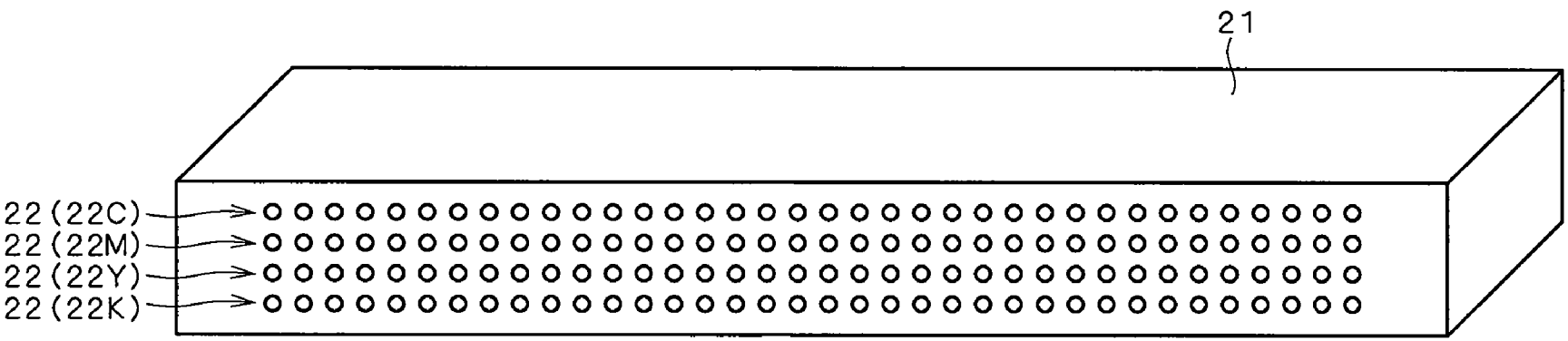
FIG. 3 is a view schematically illustrating a structure of a print head provided in a printing apparatus as seen from below.
Figure 4:
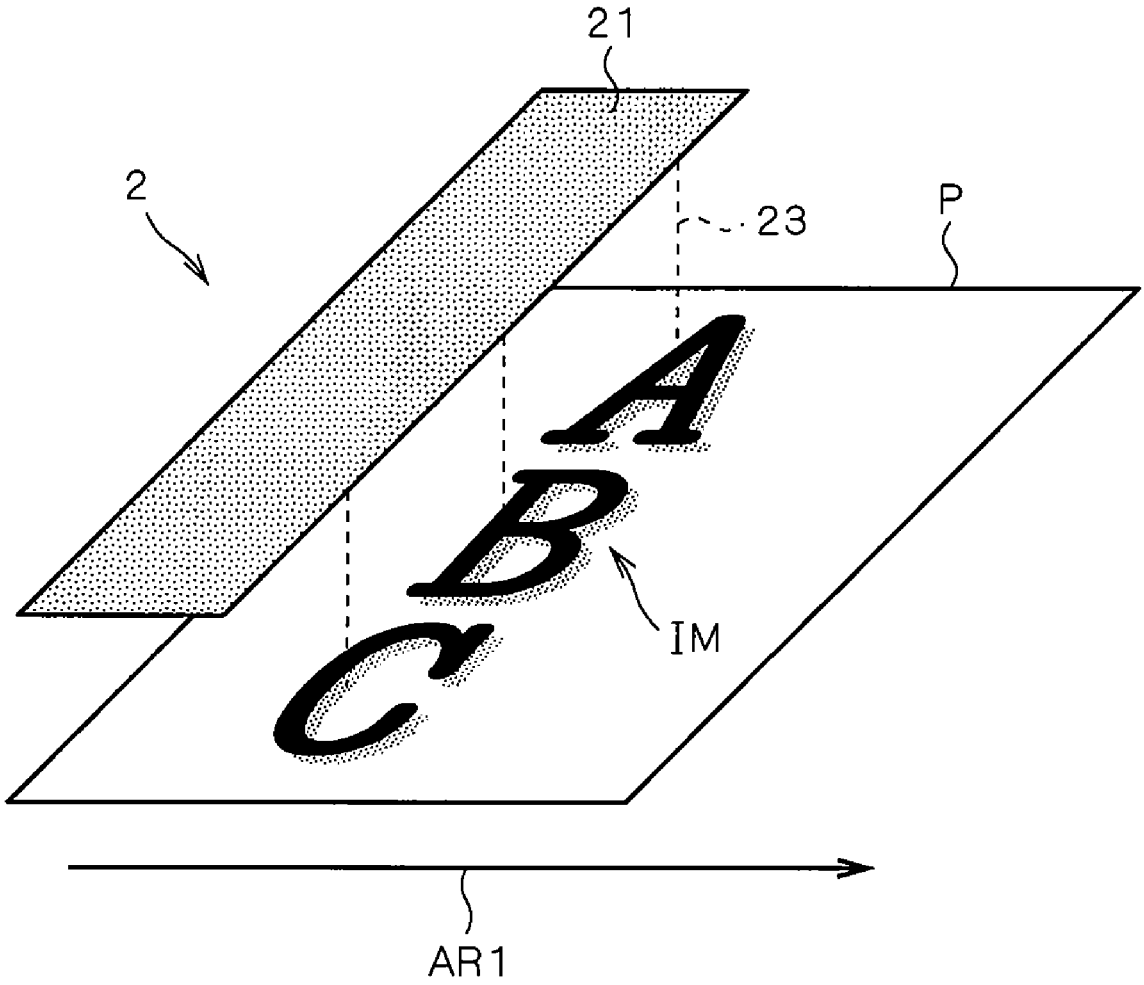
FIG. 4 is a view conceptually showing the manner of printing in the printing apparatus.

The printing apparatus 2 performs inkjet printing based on the print data DP received from the controller 3. FIG. 3 is a view schematically illustrating a structure of a print head 21 provided in the printing apparatus 2 as seen from below. FIG. 4 is a view conceptually showing the manner of printing in the printing apparatus 2. A lower surface of the print head 21 is provided with a multiplicity of nozzles 22 arranged longitudinally thereof. Under the control of the controller 3, the printing apparatus 2 causes ink stored in an ink storage part (not shown) provided inside the print head 21 to be ejected as appropriate from the nozzles 22 on a line-by-line basis toward a printing sheet P as shown in FIG. 4 while causing a transport element not shown to feed the printing sheet P in a direction indicated by the arrow AR1 under the fixed print head 21, thereby to form a printed image IM. In this process, whether to eject the ink or not is determined for each of the individual nozzles 22. Specifically, a dot corresponding to one pixel of the printed image IM is formed by the ink ejected from each of the nozzles 22. Preferably, whether each of the nozzles 22 is open or closed during the printing process is stored as nozzle status information NC, which in turn is provided to the controller 3.

The print head 21 shown in FIG. 3 is merely illustrative. The configuration of the print head 21 including the number and arrangement of the nozzles 22 is not limited to that shown in FIG. 3. In reality, the nozzles 22 are arranged in a predetermined configuration so as to achieve a printing resolution ranging from hundreds of dots per inch to thousands of dots per inch. A known inkjet printing apparatus having such a print head may be used as the printing apparatus 2 according to this preferred embodiment.

Preferably, the printing apparatus 2 is capable of color printing. For example, the printing apparatus 2 is capable of printing in four process colors: C (cyan), M (magenta), Y (yellow) and K (black). In this case, the nozzles 22 are provided in corresponding relation to the inks of the four process colors. Specifically, a multiplicity of cyan nozzles 22C for ejection of cyan ink, a multiplicity of magenta nozzles 22M for ejection of magenta ink, a multiplicity of yellow nozzles 22Y for ejection of yellow ink, and a multiplicity of black nozzles 22K for ejection of black ink are arranged, as illustrated in FIG. 3.

<Flushing Process>

Figure 5:
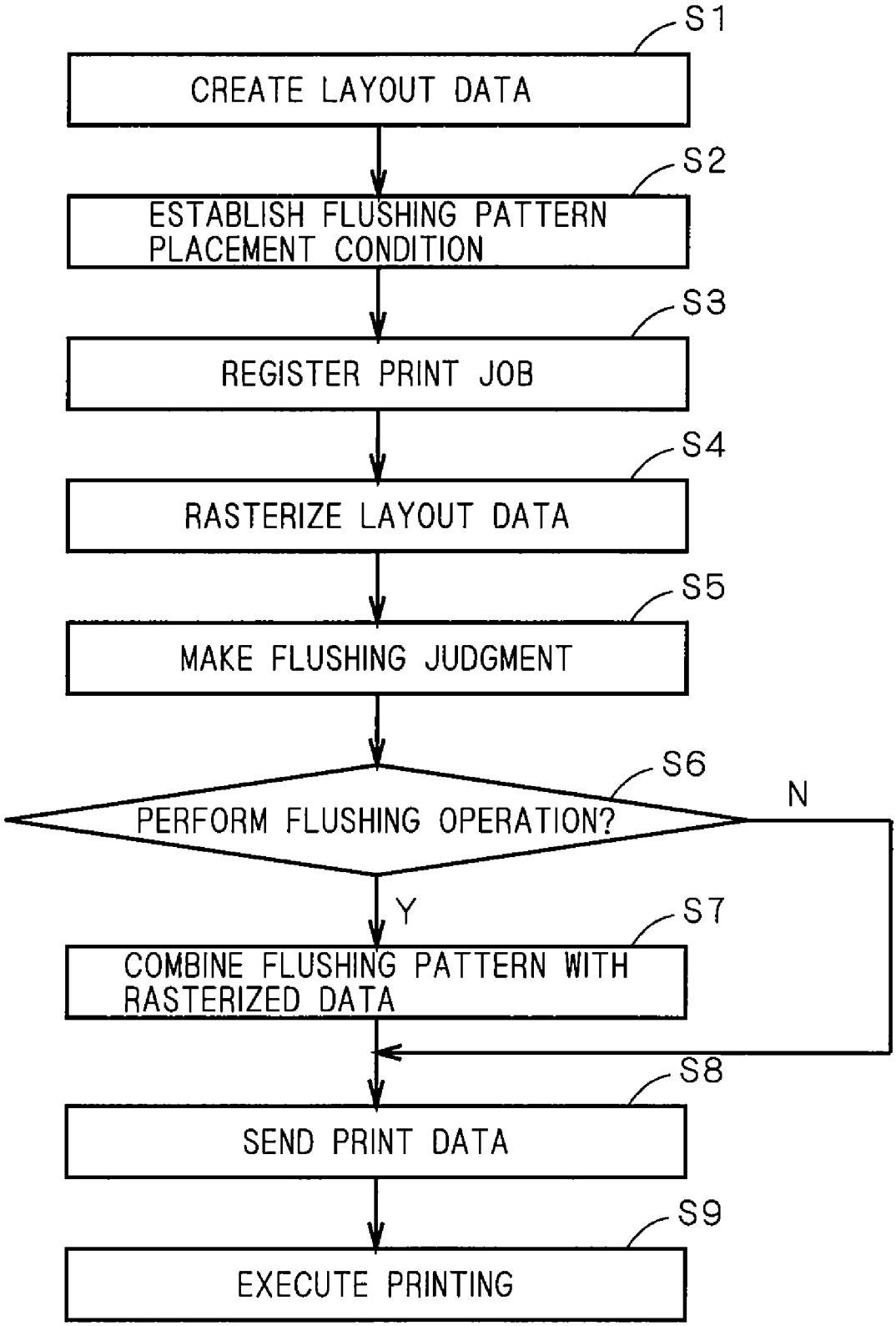
FIG. 5 is a flow diagram showing a variety of processes related to a flushing process and performed in the printing system.

The flushing process to be achieved in the printing system 100 according to the preferred embodiment of the present invention will be described hereinafter. The flushing process according to this preferred embodiment refers to the process of mainly causing a nozzle 22 which is not in use for some period of time to eject the ink in appropriately timed relation while the printing process for certain print job data DJ is being performed, thereby preventing the drying of the ink near the nozzle 22. Such an ink ejection operation is especially referred to as a flushing operation. FIG. 5 is a flow diagram showing a variety of processes related to the flushing process and performed in the printing system 100. FIG. 6 illustrates a printed material PM subjected to no flushing operation.

The printed material PM refers to one sheet included among a plurality of printed sheets (referred to as a "set of printed sheets" or collectively as a "printed sheet set") not shown which are created in such a manner that a plurality of sheets are successively printed using the same format, based on a single piece of print job data DJ, but printed contents thereon are different from each other. In other words, the printed material PM corresponds to one page of multi-page printed matter. More specifically, the printed material PM illustrated in FIG. 6 is an itemized call report for one customer included in such a printed sheet set that details of call logs of individual customers are successively printed on different sheets. Although not shown, it is assumed that the call log details printed on the respective sheets constituting the printed sheet set are actually different from each other. Such printed sheets including the printed material PM shown in FIG. 6 shall be obtained by printing on a line-by-line basis from the upper edge to the lower edge. A section a indicates a printable region (between the opposite ends of the array of nozzles 22) by the print head 21.

Creating such a printed material PM while performing the flushing process is as follows. First, the layout data DL is created as part of the creation of the print job data DJ in the job creation terminal 1 (in Step S1).

Specifically for the printed material PM, an operator performs a predetermined manipulation on the job creation terminal 1 to create the layout data DL so that printing regions RE1 to RE5, in which various contents are printed, are formed in the printed material PM (or so that ink 23 is ejected from the nozzles 22 for printing in the regions RE1 to RE5). It is assumed that the layout data DL is created in Step S1 so that ruled lines and characters are printed in 100% black, a shaded portion in the region RE1 is printed in 100% magenta, a shaded portion in the region RE2 is printed in 50% cyan, and a background portion in the region RE4 is printed in 5% yellow and 10% magenta. Because all of the sheets of this printed sheet set are printed in the same format, such color designation is also applied to other pages.

As well as creating the layout data DL, the operator performs a predetermined manipulation on the job creation terminal 1 to establish placement conditions for printing a flushing pattern as well during the printing based on the layout data DL included in the print job data DJ by the action of the flushing pattern placement establishment part 13, whereby the placement conditions are described as the placement condition data DA (in Step S2). Specifically, the placement condition data DA established herein includes a flushing pattern placement reservation region REF serving as a region in which a target nozzle 22 is caused to perform the ink ejection operation when the flushing operation is judged to be performed, the type of information and a criterion for use in the flushing judgment, the frequency of the flushing operation (flushing frequency), information for specifying the flushing pattern data DF for use in printing, and information for associating the flushing pattern placement reservation region REF and the flushing pattern data DF with each other, and the like. Preferably, the placement condition data DA may be selectable from a predetermined selection menu. The placement condition data DA may be in any description format if the descriptions of the placement condition data DA are interpretable by the controller 3.

The flushing pattern placement reservation region REF established for the printed material PM is additionally shown in FIG. 6. The flushing pattern placement reservation region REF is reserved as a region in which the flushing pattern is to be printed. The flushing pattern placement reservation region REF is determined for at least part of a plurality of printed sheets constituting the printed sheet set including the printed material PM by giving predetermined descriptions in the placement condition data DA. The flushing pattern placement reservation region REF may be determined in accordance with the layout of a printed sheet provided in the form of the layout data DL. Specifically, the flushing pattern placement reservation region REF is preferably placed in a location where the printing based on the layout data DL is not done and in a location where the provision of visual information intended by the printed sheet is not prevented. Although the flushing pattern placement reservation region REF is shown in FIG. 6 as placed in an upper end portion of the printed material PM, it is not absolutely necessary to place the flushing pattern placement reservation region REF in such a location. Variations of the placement of the flushing pattern placement reservation region REF will be described later.

In the printing system 100, when there arises a need for the flushing operation as a result of the judgment of the flushing judgment part 33F, the ink ejection from a nozzle 22 for printing a flushing pattern is performed on the flushing pattern placement reservation region REF established in accordance with the position of the nozzle 22. The flushing pattern is not always printed all over the reserved region. Dotted lines are shown in FIG. 6 for purposes of illustration. In reality, the flushing pattern placement reservation region REF is not surrounded by the dotted lines in this manner.

After the job creation terminal 1 obtains the print job data DJ for creation of such a printed material PM, the print job data DJ is passed to the controller 3 and stored in the storage part 32. At the same time, the job acceptance part 31 records information required in specifying the print job data DJ on the registered job information RI (in Step S3). A plurality of pieces of print job data DJ registered in the registered job information RI successively become a target subjected to the printing process in accordance with records in the registered job information RI. In this process, at first, the layout data DL included in the target print job data DJ is rasterized into the rasterized data DR by the action of the rasterization processing part 33R (in Step S4).

Then, the flushing judgment part 33F makes the flushing judgment in accordance with a predetermined criterion, and determines whether the flushing operation is needed or not in accordance with the result of the flushing judgment (in Steps S5 and S6). The need for the flushing of a nozzle 22 which is to eject the ink of a certain color component during printing for the printed sheet set including the printed material PM means that the nozzle 22 is not used for printing over a predetermined length of time. The flushing judgment is the process of judging whether such a situation occurs or not based on predetermined information. The information for use in the flushing judgment is not especially limited if the judgment can be made in an equivalent manner on all of the nozzles 22 and is reproducible. For instance, the flushing judgment may be made based on the frequency of use of each nozzle 22 (whether each nozzle 22 is open or closed) which is specified by analyzing the rasterized data DR or based on the nozzle status information NC regarding the usage of the nozzles 22 which is obtained from the printing apparatus 2.

It is assumed herein that the judgment is made based on the frequency of use of each nozzle 22 estimated from the rasterized data DR for the printed material PM. In this case, the flushing judgment part 33F specifies the frequency with which dots of ink are formed with each nozzle 22 in the entire range on the printed material which correspond to the position of the nozzle 22, based on the rasterized data DR. Then, the flushing judgment part 33F judges whether the flushing is needed or not, depending on whether the frequency exceeds a predetermined frequency criterion written in the placement condition data DA.

In the printing apparatus 2, the printing is done by passing a printing sheet immediately under the fixed print head 21. Thus, the positions in which there is a possibility that dots are printed on the printing sheet by the ejection of ink from a certain one of the nozzles 22 form a straight line extending in the print direction as indicated by the dash-and-dot line L1 of FIG. 6. The flushing judgment part 33F references the descriptions (e.g., address information and color component information) of the rasterized data DR to specify the frequency of occurrence of dots to be printed on the printing sheet in the direction indicated by the line L1 for each ink color component, in units of dots, thereby making the judgment based on the result thereof.

It is assumed herein that the number of dots corresponding to a printable region (from the upper edge to the lower edge) for one page of the printing sheet used for the printed material PM, which is indicated as a section d in FIG. 6, is described in the placement condition data DA as a criterion value for the flushing judgment. In this case, when the flushing judgment part 33F judges that ink will not be ejected from the nozzle 22 even if the criterion value is reached, as a result of the reference to the rasterized data DR, the flushing operation is executed. When it is judged that there is a nozzle 22 required to perform the flushing operation in a certain range of pages during the printing for the printed sheet set, the flushing frequency is determined so that the flushing pattern is printed in the flushing pattern placement reservation region REF established on a sheet to be printed first in the certain range of pages, and is described in the placement condition data DA.

In the printing for a printed sheet set including the printed material PM shown in FIG. 6, the ruled lines and characters are printed in 100% black, the shaded portion in the region RE1 is printed in 100% magenta, the shaded portion in the region RE2 is printed in 50% cyan, and the background portion in the region RE4 is printed in 5% yellow and 10% magenta, as mentioned above. In a section b, black ink is used to print the ruled lines, and cyan, magenta and yellow inks are used to print the shaded portions. Because all of the inks are used for the printing across the section b, all of the nozzles 22 are used at least once in the section b. The same is true for all printing sheets to be printed in the same format. Therefore, the nozzles 22 responsible for the printing in the section b eject ink at least once for each sheet.

In a section c, the black, magenta and yellow inks are used to print the ruled lines and the shaded portions as in the section b, but there is no region in which the cyan ink is used for printing. It is therefore found that there are no occasions when some of the cyan nozzles 22C which are responsible for the printing in the section c by using the cyan ink in the print head 21 eject the cyan ink even if the criterion is reached.

Thus, the flushing judgment part 33F judges that some of the cyan nozzles 22C which will not eject ink even if the criterion is reached are present among the nozzles 22 corresponding to the section c as a result of the reference to the rasterized data DR and the flushing operation is needed for these cyan nozzles 22C (YES in Step S6).

After it is judged that the flushing operation is needed, the printing execution instruction part 34 acquires the flushing pattern data DF stored in the storage part 32 to combine the flushing pattern data DF with the rasterized data DR (in Step S7). Preferably, a plurality of pieces of data containing different flushing pattern designs and the like are stored as the flushing pattern data DF in the storage part 32, and one of the pieces of flushing pattern data DF may be selected in addition to the establishment of the flushing pattern placement reservation region REF during the establishment of the placement condition data DA in the flushing pattern placement establishment part 13. Information for specifying the selected piece of flushing pattern data DF is also described in the placement condition data DA. Alternatively, the piece of flushing pattern data DF stored in the storage part 32 may be made selectable at the time that it is found that the flushing operation is needed as a result of the flushing judgment.

The cyan nozzles 22C responsible for the printing in the section c are not used for all pages of the printed sheet set including the printed material PM shown in FIG. 6. Thus, it is needed to execute the printing of the flushing pattern on all pages for ink ejection from the cyan nozzles 22C for the implementation of the flushing operation based on the flushing frequency established as mentioned above. Therefore, the flushing pattern data DF is combined with the rasterized data DR so that the flushing pattern is printed in the flushing pattern placement reservation region REF on all pages.

Then, the printing execution instruction part 34 sends to the printing apparatus 2 the print data DP including the rasterized data DR with which the flushing pattern data DF is combined and the printing condition data DC corresponding to the rasterized data DR (in Step S8). If it is judged that there is no need to perform the flushing operation (NO in Step S6), the print data DP including the rasterized data DR and the printing condition data DC corresponding thereto is sent to the printing apparatus 2 without the combining process.

Upon receipt of the print data DP, the printing apparatus 2 executes the printing of the rasterized data DR including the flushing pattern data DF, based on the printing condition data DC, to create the printed sheet set including the printed material PM (in Step S9).

FIG. 7 illustrates the printed material PM of FIG. 6 with a flushing pattern FP printed thereon based on the flushing pattern data DF. The flushing pattern FP is formed based on the flushing pattern data DF associated with the flushing pattern placement reservation region REF in the placement condition data DA. A pattern having contiguous stars are shown in FIG. 7 across the section a, but is merely illustrative. Other patterns may be used so long as the patterns require the ejection of ink at least once from a nozzle 22 subjected to the flushing operation. Ink is ejected at least once from all of the nozzles 22 to form the flushing pattern FP of FIG. 7 because there is no spacing between the stars. Thus, the flushing pattern FP of FIG. 7 satisfies the above-mentioned requirement.

Because the flushing pattern data DF is combined with the rasterized data DR in accordance with the placement condition data DA containing the above-mentioned descriptions, cyan ink is ejected also in the section c on each sheet of the printed sheet set not shown.

The frequency of printing of the flushing pattern may be freely set by appropriately establishing the descriptions of the placement condition data DA. The flushing pattern need not always be printed on all of the individual sheets. The frequency of printing of the flushing pattern may be appropriately determined, e.g., every two pages or every three pages, depending on the drying performance of the ink.

For the color designation of the flushing pattern FP, the color type and color density value are not essentially limited if the flushing pattern FP includes the color of ink ejected from the nozzles 22 required to perform the flushing operation. By taking advantage of the fact that the color type of the ink ejected from the nozzles 22 required to perform the flushing operation can be specified from the rasterized data DR, it is assumed herein that printing is done using the ink of the specified color type at a color density of 50%. Because only the cyan ink necessitates the flushing operation for the entire printed sheet set including the printed material PM, the flushing pattern FP is printed in 50% cyan throughout. For such designation, the flushing pattern data DF is stored as data containing no information about the color type (but adapted for subsequent addition thereof) in the storage part 32. The manner of color designation, however, is not limited to that described above, but will be described later.

The flushing judgment based on the nozzle status information NC indicating whether the nozzles are used or not is made in a manner to be described below as an example. During the printing process, the flushing judgment part 33F judges whether a nozzle has not been subjected to the ejection for a fixed period of time is present or absent, based on real-time information about the opening and closing timing of each nozzle which is provided from the printing apparatus 2. When such a nozzle is present, the flushing pattern data DF is combined with the rasterized data DR in accordance with the descriptions of the placement condition data DA, and the flushing is performed. Pieces of data are successively transferred from the controller 3 to the printing apparatus 2.

As described above, the printing system 100 according to this preferred embodiment does not limit the position of the flushing pattern to a particular region (e.g., a perforated tear-off region, a binding margin region, a region between images, a region for bleeding and the like). In the printing system 100, an arbitrary position can be previously designated as the flushing pattern placement reservation region REF during the creation of the print job data DJ in the job creation terminal 1 and be described in the placement condition data DA, as mentioned above. The flushing pattern data DF for printing of a predetermined flushing pattern FP is previously stored in the storage part 32. When the need for the flushing operation arises, the flushing pattern data DF is selected from the storage part 32 and combined with the rasterized data DR. This achieves the formation of a flushing pattern in accordance with the established flushing pattern placement reservation region REF.

The printing system 100 eliminates the presence of nozzles 22 having no opportunity to eject ink for a long period of time during the printing for a printed sheet set composed of a multiplicity of printed sheets or for continuous roll of paper, thereby preventing the drying of the nozzles 22 and the like.

This significantly contributes to the improvement in print quality of the whole printed sheet set.

It is usually difficult to know the frequency of ejection of ink from each nozzle in the layout stage, and it is practically impossible to grasp what kind of flushing operation is optimum in the layout stage. According to this preferred embodiment, whether the flushing operation is required or not is judged in the stage of execution of the printing process in accordance with the rasterized data which is data corresponding to the presence/absence of the occasion of ink ejection from each nozzle or in accordance with whether ink is actually ejected from each nozzle or not. This preferred embodiment can execute the flushing operation with optimum frequency without grasping such information in the layout stage only by previously establishing the flushing pattern placement reservation region in which the flushing operation is to be performed if the need for the flushing operation arises.

<Variations of Placement of Flushing Pattern>

Next, description will be given on variations of the placement of the flushing pattern according to the preferred embodiment of the present invention.

The flushing operation is the ink ejection operation which is not directly relevant to what is to be printed and expressed by a printed material and which is originally unnecessary from the viewpoint of the creation of the printed material. In the flushing operation, more ink than necessary need not be ejected if only the drying of ink is prevented. The objective of the flushing operation is accomplished if ink is ejected at least once (for one dot) per page from a nozzle 22 judged to require the flushing operation. The essential objective of the flushing operation is accomplished if the flushing pattern data DF is provided which causes such ink ejection. In the above-mentioned case, the objective will be accomplished even by the printing of a linear flushing pattern FP having, for example, one or several dots in width in a region corresponding to at least the section c. It is not essentially necessary to print the flushing pattern FP across the section a as shown in FIG. 7, that is, to cause the ink ejection also from the cyan nozzles 22C for ejecting ink in the position of the section b which does not require the flushing operation.

Which nozzles are to perform the flushing operation among the multiplicity of nozzles 22 arranged in the fixed print head 21 differs depending on the descriptions of the rasterized data DR for use in the printing, and is neither specified as a continuous range (the section c) nor be the same for all of the pages. Thus, there are various combinations of nozzles required to perform the flushing operation. It is hence impractical to previously prepare a multiplicity of flushing patterns in corresponding relation to all of the various combinations of the nozzles 22.

Almost all printed materials are required to be good-looking in what is printed and to look less uncomfortable depending on the type and application thereof. It is hence preferred that the flushing patterns are of somewhat tasteful design. For the formation of the flushing patterns, it is preferred not only to eject ink from the nozzles 22 which originally need the flushing but also to make a somewhat tasteful design.

In view of foregoing, it can be said that a flushing pattern created in the printed material is preferably a pattern formed using an appropriate number of nozzles 22 in corresponding relation to the various combinations of the nozzles 22 for which the flushing operation is needed and including at least the color of the ink ejected from the nozzles for which the flushing operation is needed, and is preferably of somewhat tasteful design. These preferred requirements need not be satisfied by a single flushing pattern but may be properly shared between flushing patterns in accordance with the layouts of the printed materials.

FIGS. 8A to 8D show variations of the placement of the flushing pattern formed based on the above-mentioned requirements. Because the type of the flushing pattern to be placed can be determined in association with the position of the flushing pattern placement reservation region, it can be said that FIGS. 8A to 8D show variations of the establishment of the flushing pattern placement reservation region. It is assumed that all of the printed materials shown in FIGS. 8A to 8D are obtained by printing in a direction from the upper edge to the lower edge in a manner similar to the printed material PM shown in FIG. 6. The right-hand and left-hand printing bounds for each of the printed materials shown in FIGS. 8A to 8D shall correspond to the full printable bounds of the print head 21. The flushing patterns are shown in FIGS. 8A to 8D as having a rectangular shape for ease of illustration. However, the shape of the flushing patterns is not limited to the rectangular shape in practice. Various patterns including the above-mentioned pattern composed of contiguous stars and the like may be used as the flushing patterns.

Figure 8A:
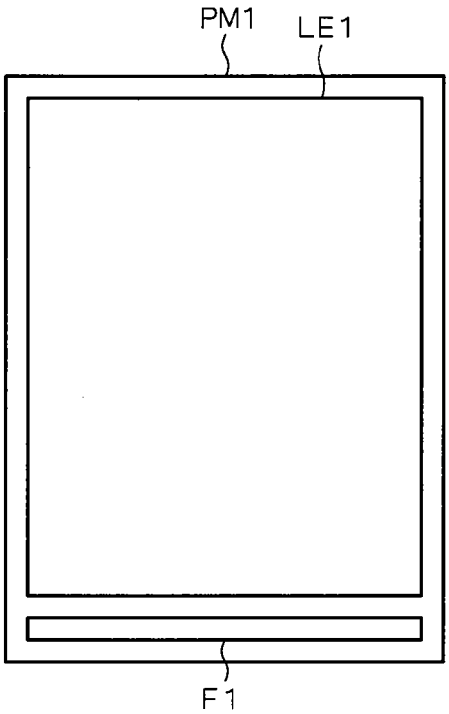
FIGS. 8A to 8D show variations of the placement of the flushing pattern.

FIG. 8A shows a printed material PM1 including a flushing pattern F1 placed under a layout region LE1 and extending to the right-hand and left-hand full printable bounds. The flushing pattern placement reservation region REF may be established so that the flushing pattern F1 is placed in such a manner, if it is difficult to place the flushing pattern in an upper portion as in the printed material PM shown in FIG. 6. Additionally, when the upper and lower bounds of the establishment of the flushing pattern placement reservation region coincide with those of the flushing pattern placement reservation region REF shown in FIG. 6, the flushing pattern FP composed of the stars shown in FIG. 7 may be selected.

Figure 8B:
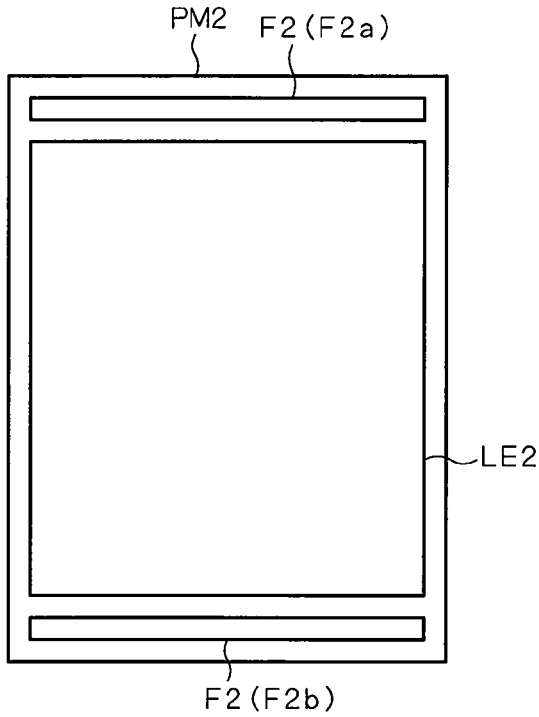

FIG. 8B shows a printed material PM2 including an upper flushing pattern F2*a* and a lower flushing pattern F2*b* on opposite sides of a layout region LE2. The upper and lower flushing patterns F2*a* and F2*b* designated may be identical with or different from each other. This is achieved, for example, by previously setting these two locations as the flushing pattern placement reservation region REF and making a description in the placement condition data DA so that the flushing patterns are formed in different positions depending on the color types of the ink ejected from the nozzles for which the flushing operation is needed. A flushing pattern may be formed in any one of the positions in accordance with page numbers.

Figure 8C:
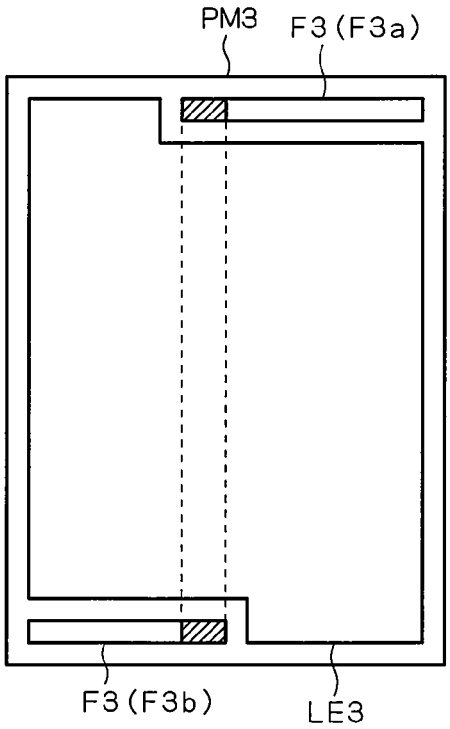

FIG. 8C shows a printed material PM3 which is similar to the printed material PM2 in that upper and lower flushing patterns F3*a* and F3*b* are formed on opposite sides of a layout region LE3 but differs therefrom in that each of the flushing patterns F3*a* and F3*b* alone does not extend to both the right-hand and left-hand full printable bounds. In this case, the placement condition data DA may have a description so that only one of the flushing patterns F3*a* and F3*b* is formed in accordance with the position of the nozzles for which the flushing operation is needed. The printing bounds of the flushing patterns F3*a* and F3*b* have an overlapping portion indicated as a shaded portion. This overlapping portion is not necessary as far as only the flushing operation is performed, but is provided because of design demand.

Figure 8D:
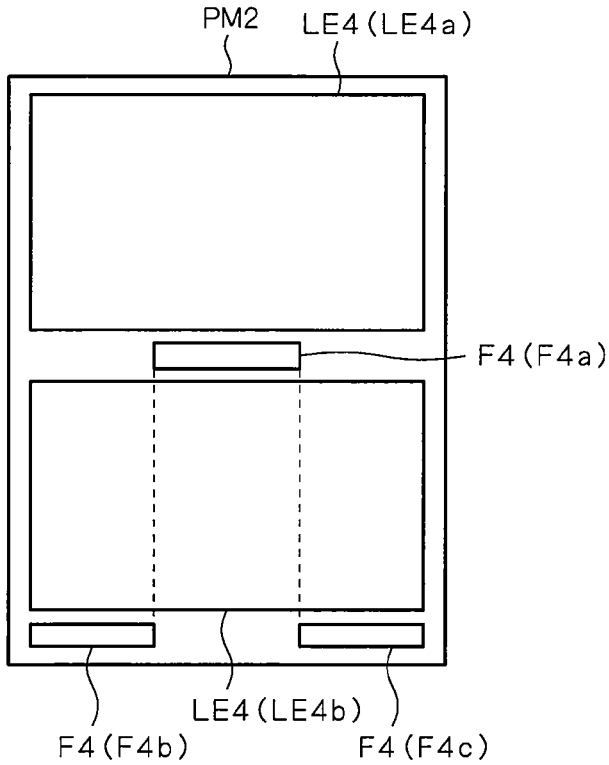

FIG. 8D shows a printed material PM4 including two layout regions LE4*a* and LE4*b*, a flushing pattern F4*a* formed therebetween, and flushing patterns F4*b* and F4*c* under the lower layout region LE4*b*. In this case, the placement condition data DA may have a description so that only one of the flushing patterns F4*a* to F4*c* is formed in accordance with the position of the nozzles for which the flushing operation is needed.

For the flushing process for causing the nozzles 22 of the print head 21 provided in the printing apparatus 2 to perform the flushing operation in the printing system 100 according to the preferred embodiment of the present invention as described hereinabove, the position in which the flushing operation, when needed, is executed on the printed material is previously determined as the placement reservation region in accordance with the descriptions of the layout data, whereby the flushing pattern is formed so as not to prevent the original visual effect of the printed material. In addition, the flushing pattern is formed using not only the nozzles for which the flushing operation is needed but also other nozzles. Thus, preparing at least the flushing pattern in accordance with variations of the placement of the flushing pattern placement reservation region eliminates the need to previously prepare a multiplicity of flushing patterns corresponding to all of the various combinations of the nozzles 22 which require the flushing operation. The use of not only the nozzles for which the flushing operation is needed but also other nozzles for the formation of the flushing pattern allows the provision of somewhat tasteful design to the flushing pattern to be formed, and allows the formation of the flushing pattern so as to minimize the hindrance to the original visual effect of the printed material. Thus, the printing system 100 is capable of the flushing process with greater flexibility.

While the invention has been described in detail, the foregoing description is in all aspects illustrative and not restrictive. It is understood that numerous other modifications and variations can be devised without departing from the scope of the invention.

What is claimed is:

1. A printing system comprising:

a) a printing apparatus including a fixed print head having a plurality of nozzles arranged in an array, said printing apparatus ejecting ink from said plurality of nozzles based on predetermined printing data to perform printing on a printing sheet; and b) a controller for said printing apparatus, said controller including b-1) a storage element for storing predetermined information therein, b-2) a generation element for generating said printing data in accordance with descriptions of predetermined print job data stored in said storage element, b-3) a judgment element for acquiring information about whether said plurality of nozzles are open or closed during a printing process for said print job data in said printing apparatus to judge whether a flushing operation of said plurality of nozzles is needed or not based on said information, and b-4) a combination element for combining flushing data with said printing data in accordance with a predetermined condition, said flushing data being data for causing the flushing operation in a predetermined timed relationship during the printing process, said flushing data being previously stored in said storage element, said flushing data being combined with said printing data when said judgment element judges that said flushing operation is needed.

2. The printing system according to claim 1, further comprising c) a print job creation apparatus including c-1) a layout element for creating layout data, said layout data representing a layout for a printed material, and c-2) a reservation element for creating reservation data, said reservation data specifying a placement reservation position in which a flushing pattern represented by said flushing data is to be placed on said printed material, said print job data including said layout data and said reservation data, wherein, when it is judged that said flushing operation is needed, said combination element combines said flushing data with said printing data in accordance with descriptions of said reservation data, and said printing apparatus prints said flushing pattern in said placement reservation position.

3. The printing system according to claim 1, wherein said judgment element judges whether a less-frequently-used nozzle which does not eject ink even if a predetermined frequency criterion is reached is present or absent, thereby to judge whether said flushing operation is needed or not.

4. The printing system according to claim 3, wherein:

said generation element generates rasterized data as said printing data; and said judgment element judges whether said flushing operation is needed or not in accordance with descriptions of said rasterized data.

5. The printing system according to claim 3, wherein:

said printing apparatus provides opening/closing information about said plurality of nozzles during said printing process to said controller; and said judgment element judges whether said flushing operation is needed or not in accordance with said opening/closing information.

6. A controller for a printing apparatus including a fixed print head having a plurality of nozzles arranged in an array, said printing apparatus ejecting ink from said plurality of nozzles based on predetermined printing data to perform printing on a printing sheet, said controller comprising:

a) a storage element for storing predetermined information therein;

b) a generation element for generating said printing data in accordance with descriptions of predetermined print job data stored in said storage element;

c) a judgment element for acquiring information about whether said plurality of nozzles are open or closed during a printing process for said print job data in said printing apparatus to judge whether a flushing operation of said plurality of nozzles is needed or not based on said information; and d) a combination element for combining flushing data with said printing data in accordance with a predetermined condition, said flushing data being data for causing the flushing operation in a predetermined timed relationship during the printing process, said flushing data being previously stored in said storage element, said flushing data being combined with said printing data when said judgment element judges that said flushing operation is needed.

7. The controller according to claim 6, wherein:

said print job data is provided as data including layout data and reservation data, said layout data representing a layout for a printed material, said reservation data specifying a placement reservation position in which a flushing pattern represented by said flushing data is to be placed on said printed material; and when it is judged that said flushing operation is needed, said combination element combines said flushing data with said printing data in accordance with descriptions of said reservation data, and said printing apparatus prints said flushing pattern in said placement reservation position.

8. The controller according to claim 6, wherein said judgment element judges whether a less-frequently-used nozzle which does not eject ink even if a predetermined frequency criterion is reached is present or absent, thereby to judge whether said flushing operation is needed or not.

9. The controller according to claim 8, wherein:

said generation element generates rasterized data as said printing data; and said judgment element judges whether said flushing operation is needed or not in accordance with descriptions of said rasterized data.

10. The controller according to claim 8, wherein:

opening/closing information about said plurality of nozzles during said printing process is provided from said printing apparatus; and said judgment element judges whether said flushing operation is needed or not in accordance with said opening/closing information.

11. A print job creation apparatus for providing print job data to a controller for a printing apparatus including a fixed print head having a plurality of nozzles arranged in an array, said print job creation apparatus comprising:

a) a layout element for creating layout data, said layout data representing a layout for a printed material; and b) a reservation element for creating reservation data, said reservation data specifying a placement reservation position in which a flushing pattern represented by said flushing data is to be placed on said printed material, said print job data including said layout data and said reservation data, said flushing data being data for causing a flushing operation in a predetermined timed relationship during a printing process, said printing apparatus ejecting ink from said plurality of nozzles based on predetermined printing data to perform printing on a printing sheet, said printing apparatus printing said flushing pattern in said placement reservation position when it is judged that said flushing operation is needed, said controller including a storage element for storing predetermined information therein, a generation element for generating said printing data in accordance with descriptions of said print job data stored in said storage element, a judgment element for acquiring information about whether said plurality of nozzles are open or closed during a printing process for said print job data in said printing apparatus to judge whether said flushing operation of said plurality of nozzles is needed or not based on said information, and a combination element for combining said flushing data previously stored in said storage element with said printing data in accordance with descriptions of said reservation data when said judgment element judges that said flushing operation is needed.

12. A method of executing a printing process in a printing apparatus, said printing apparatus including a fixed print head having a plurality of nozzles arranged in an array, said printing apparatus ejecting ink from said plurality of nozzles based on predetermined printing data to perform printing on a printing sheet, said method comprising the steps of:

a) generating said printing data in accordance with descriptions of predetermined print job data stored in a predetermined storage element;

b) acquiring information about whether said plurality of nozzles are open or closed during a printing process for said print job data in said printing apparatus to judge whether a flushing operation of said plurality of nozzles is needed or not based on said information;

c) combining flushing data with said printing data in accordance with a predetermined condition when it is judged in said step b) that said flushing operation is needed; and d) performing printing based on said printing data in said printing apparatus, said flushing data being previously stored in said storage element, said flushing data being data for causing the flushing operation in a predetermined timed relationship during the printing process, wherein, when said flushing data is combined with said printing data, printing is done in said step d) based on said printing data with which said flushing data is combined.

13. The method according to claim 12, further comprising the steps of:

e) creating layout data, said layout data representing a layout for a printed material; and f) creating reservation data, said reservation data specifying a placement reservation position in which a flushing pattern represented by said flushing data is to be placed on said printed material, said print job data including said layout data and said reservation data, wherein, when it is judged that said flushing operation is needed, said flushing data is combined with said printing data in accordance with descriptions of said reservation data in said step c), and said flushing pattern is printed in said placement reservation position in said step d).

14. The method according to claim 12, wherein whether a less-frequently-used nozzle which does not eject ink even if a predetermined frequency criterion is reached is present or absent is judged in said step b), whereby whether said flushing operation is needed or not is judged.

15. The method according to claim 14, wherein:

rasterized data is generated as said printing data in said step a); and whether said flushing operation is needed or not is judged in accordance with descriptions of said rasterized data in said step b).

16. The method according to claim 14, wherein whether said flushing operation is needed or not is judged in accordance with opening/closing information about said plurality of nozzles during said printing process in said step b).

17. A computer-readable recording medium, storing a program executed in a computer thereby to cause said computer to function as a controller for a printing apparatus including a fixed print head having a plurality of nozzles arranged in an array, said printing apparatus ejecting ink from said plurality of nozzles based on predetermined printing data to perform printing on a printing sheet, said controller comprising:

a) a storage element for storing predetermined information therein;

b) a generation element for generating said printing data in accordance with descriptions of predetermined print job data stored in said storage element;

c) a judgment element for acquiring information about whether said plurality of nozzles are open or closed during a printing process for said print job data in said printing apparatus to judge whether a flushing operation of said plurality of nozzles is needed or not based on said information; and d) a combination element for combining flushing data with said printing data in accordance with a predetermined condition, said flushing data being data for causing the flushing operation in a predetermined timed relationship during the printing process, said flushing data being previously stored in said storage element, said flushing data being combined with said printing data when said judgment element judges that said flushing operation is needed.

18. A computer-readable recording medium, storing a program executed in a computer thereby to cause said computer to function as a print job creation apparatus for providing print job data to a controller for a printing apparatus including a fixed print head having a plurality of nozzles arranged in an array, said print job creation apparatus comprising:

a) a layout element for creating layout data, said layout data representing a layout for a printed material; and b) a reservation element for creating reservation data, said reservation data specifying a placement reservation position in which a flushing pattern represented by said flushing data is to be placed on said printed material, said print job data including said layout data and said reservation data, said flushing data being data for causing a flushing operation in a predetermined timed relationship during a printing process, said printing apparatus ejecting ink from said plurality of nozzles based on predetermined printing data to perform printing on a printing sheet, said printing apparatus printing said flushing pattern in said placement reservation position when it is judged that said flushing operation is needed, said controller including a storage element for storing predetermined information therein, a generation element for generating said printing data in accordance with descriptions of said print job data stored in said storage element, a judgment element for acquiring information about whether said plurality of nozzles are open or closed during a printing process for said print job data in said printing apparatus to judge whether said flushing operation of said plurality of nozzles is needed or not based on said information, and a combination element for combining said flushing data previously stored in said storage element with said printing data in accordance with descriptions of said reservation data when said judgment element judges that said flushing operation is needed.

* * * * *